US006390386B2

(12) United States Patent
Krohn et al.

(10) Patent No.: US 6,390,386 B2
(45) Date of Patent: May 21, 2002

(54) AIRLESS REVERSIBLE SPRAY TIP

(75) Inventors: Duane D. Krohn, Westminster, CO (US); Miroslav Liska, Somis, CA (US)

(73) Assignee: Durotech Company, Moorpark, CA (US)

( * ) Notice: Subject to any disclaimer, the term of this patent is extended or adjusted under 35 U.S.C. 154(b) by 0 days.

(21) Appl. No.: 09/877,487

(22) Filed: Jun. 7, 2001

Related U.S. Application Data

(63) Continuation of application No. 09/407,920, filed on Sep. 29, 1999, now Pat. No. 6,264,115.

(51) Int. Cl.[7] ..... B05B 15/02
(52) U.S. Cl. ..... 239/119; 239/71
(58) Field of Search ..... 239/119, 71

(56) References Cited

U.S. PATENT DOCUMENTS

| | | | | |
|---|---|---|---|---|
| 3,556,411 | A | 1/1971 | Nord | 239/581 |
| 3,593,920 | A | 7/1971 | Watson | 239/119 |
| 3,599,876 | A | 8/1971 | Kyburg | 239/291 |
| 3,627,334 | A | 12/1971 | Reddy | 277/166 |
| 3,667,681 | A | 6/1972 | Blancha | 239/393 |
| 3,709,256 | A | 1/1973 | Gore et al. | 137/625.47 |
| 3,799,440 | A | 3/1974 | Goss et al. | 239/120 |
| 3,836,082 | A | 9/1974 | Krohn | 239/526.239 |
| 3,880,355 | A | 4/1975 | Larson et al. | 239/288.3 |
| 3,944,141 | A | 3/1976 | Siczek | 239/288.5 |
| 3,952,955 | A | 4/1976 | Clements | 239/288.5 |
| 3,955,763 | A | 5/1976 | Pyle et al. | 239/119 |
| 3,963,180 | A | 6/1976 | Wagner | 239/288.5 |
| 4,025,045 | A | 5/1977 | Kubiak | 239/288.5 |
| 4,036,438 | A | 7/1977 | Soderlind | 239/288.5 |
| 4,074,857 | A | 2/1978 | Calder | 239/119 |
| 4,116,386 | A | 9/1978 | Calder | 239/119 |
| 4,126,272 | A | 11/1978 | Geberth, Jr. | 239/455 |
| 4,165,836 | A | 8/1979 | Eull | 239/119 |
| 4,181,261 | A | 1/1980 | Crum | 239/288.5 |
| 4,220,286 | A | 9/1980 | Geberth, Jr. | 239/455 |
| 4,239,157 | A | 12/1980 | Fasth | 239/288.5 |
| 4,256,260 | A | 3/1981 | Piggott | 239/119 |
| 4,331,296 | A | 5/1982 | Levey | 239/288 |
| 4,331,299 | A | 5/1982 | Culbertson et al. | 239/691 |
| 4,424,761 | A | 1/1984 | Thorn et al. | 118/300 |
| 4,437,610 | A | 3/1984 | Huber et al. | 239/119 |
| 4,465,236 | A | 8/1984 | Calder | 239/391 |
| 4,477,109 | A | 10/1984 | Kleuver | 285/361 |
| 4,479,513 | A | 10/1984 | Koch et al. | 137/625.47 |
| 4,483,481 | A | 11/1984 | Calder | 239/119 |
| 4,484,707 | A | 11/1984 | Calder | 239/119 |
| 4,489,893 | A | 12/1984 | Smead | 239/691 |
| 4,508,268 | A | 4/1985 | Gebeeth, Jr. | 239/119 |
| 4,537,355 | A | 8/1985 | Calder | 239/119 |
| 4,560,109 | A | 12/1985 | Teruyuki et al. | 239/583 |
| 4,611,758 | A | 9/1986 | Geberth, Jr. | 239/119 |

(List continued on next page.)

*Primary Examiner*—Lesley D. Morris
(74) *Attorney, Agent, or Firm*—Koppel, Jacobs, Patrick & Heybl

(57) ABSTRACT

An improved reversible airless spray tip inhibits dripping, spitting, and undesirable paint accumulation on the spray guard, while improving safety. A positioning detent on the spray tip carrier handle snaps positively into place when a nozzle carrier is rotated into spray position, indicating that the tip is properly positioned for spraying. A spray guard with airfoil-like cross-members protects the user from injury while they inhibit turbulence and prevent paint accumulation. An improved piston seal has a slot-like fluid passage, which is preferably substantially rectangular in cross section. A rearward end of the piston seal is sealed by a resilient ring compressed directly against the face of an attached spray gun. An improved tip retainer is expanded by swaging after insertion, which forces a lip into a mating slot. The tip retainer also has an expanded chamber which diffuses reverse fluid flow for safety.

10 Claims, 9 Drawing Sheets

U.S. PATENT DOCUMENTS

| | | | | |
|---|---|---|---|---|
| 4,635,850 | A | 1/1987 | Leisi | 239/119 |
| 4,685,621 | A | 8/1987 | Scherer et al. | 239/288 |
| 4,715,537 | A | 12/1987 | Calder | 239/119 |
| 4,757,947 | A | 7/1988 | Calder | 239/119 |
| 4,830,281 | A | 5/1989 | Calder | 239/119 |
| 4,971,249 | A | 11/1990 | McKee | 239/119 |
| 5,340,029 | A | 8/1994 | Adams | 239/119 |
| 5,425,506 | A | 6/1995 | Careu | 239/288 |
| 5,451,000 | A | 9/1995 | Shaw et al. | 239/71 |
| 5,765,753 | A | 6/1998 | Kiefer | 239/119 |
| 5,947,381 | A | 9/1999 | Carey | 239/119 |

AIRLESS REVERSIBLE SPRAY TIP

This application is a continuation of U.S. patent application Ser. No. 09/407,920 filed Sep. 29, 1999 now U.S. Pat. No. 6,264,115, and claims priority of that application.

BACKGROUND OF THE INVENTION

1. Field of the Invention:

The invention relates generally to spray tip assemblies for airless, high pressure spraying, and more particularly to reversible spray tip assemblies provided with a tip guard for safety.

2. Description of the Related Art

Reversible spray tip assemblies are widely used for high pressure, airless spraying of paint and other fluids. In a typical reversible spray tip assembly, a small spray nozzle is carried in a cylindrical, rotatable nozzle carrier. The nozzle carrier can be rotated 180 degrees, thereby reversing the direction of paint flow through the nozzle for cleaning nozzle obstructions. Typically the nozzle carriers are interchangeable with other nozzle carriers carrying nozzles of various diameters and capacities. Prior reversible spray tip assemblies, although successful, continue to be plagued by several problems which affect their convenience, safety and utility.

Safety for the user is a primary concern. Airless high pressure sprayers eject a very high velocity, narrow jet, which disperses and slows as it atomizes. In the area near the nozzle (within approximately one inch), where the jet is most narrow and has highest velocity, there is a risk of injection injuries to a user. In recognition of this risk, prior sprayers have included various styles of spray guards to prevent the user's body from being hit by the spray jet near the spray nozzle orifice and to warn the user of the hazard.

While such spray guards reduce the risk of injection, prior spray guards have generally suffered from a tendency to accumulate paint during spraying. Accumulated paint can then drip from the guard, creating a mess and potentially staining clothing or surfaces in the work area. . In addition, accumulated paint can be splattered from the tip guard by the aerodynamic forces of the spray, causing imperfections on the painted surface. When this occurs, the user may be tempted to remove the spray guard, thereby risking injury for the sake of convenience.

Some efforts have been made to reduce the tendency for the spray guard to accumulate paint. For example, U.S. Pat. No. 4,685,621 to Scherer et al. (1987) features a tip guard having two pairs of vanes extending forward and radially outward from a base, each pair of vanes joined by a crossbar. Scherer's tip guard allows air flow through the side of the spray guard, and is somewhat successful in reducing buildup of paint on the spray guard. Nevertheless, the accumulation of paint from overspray is not completely eliminated by Scherer's design, and users may still be tempted to remove the spray guard.

Another approach to the problem is taken by Eull in his U.S. Pat. No. 4,165,836 (1979). This patent describes a safety tip guard which is coupled to the sprayer in such a way that the spray tip will not operate if the tip guard is removed. This approach improves the safety of the spray guard, but paint can still accumulate and drip. In addition, the user may be forced to stop to wipe the spray guard occasionally; if the sprayer is actuated while the user has positioned fingers inside the guard for wiping, injection injury could result.

While prior attempts to improve the spray guard have improved the situation to some degree, none of the prior guards is considered convenient, safe and trouble free.

A related problem with existing reversible tip spray tips arises from their reversible tip feature. It is a major benefit of such devices that a user can easily rotate the spraying nozzle into a reverse flow position. This enables the user to quickly remove any particles that have plugged the very small orifice in the spray tip, by injecting paint through the spray tip in the reversed flow direction, dislodging the obstruction. However, with existing reversible tip devices it is possible to accidentally rotate the spray tip out of position if the tip handle gets bumped in the course of handling or moving the spray gun. It is also possible for a user to fail to rotate the spray tip completely into position before activating the sprayer. Either of these circumstances can yield a condition where the tip is not properly aligned when fluid pressure is applied, which can result in accidents ranging in severity from minor nuisance to serious injury or damage.

Prior reversible spray tips commonly include rotation stops, so that the tip cannot be overrotated inadvertently. For example, U.S. Pat. No. 4,165,836 to Eull (1979) includes a handle with a shoulder. The shoulder has a partially rounded shape to permit tip rotation and a flattened portion which contacts a flange to limit the range of rotation. While it does prevent overrotation, the flattened portion of the shoulder does not prevent improper positioning by underrotation of the tip. Other tips similarly limit the range of rotation but do not positively lock the tip into position. Thus, prior spray tips do not completely solve the problem of inadvertent tip misalignment.

In addition to misalignment problems, prior reversible spray tips are subject to "spitting" and dripping problems when the spray gun is being triggered on or off. These problems are related to the seal design. For sealing the rotatable metal cylinder, a floating cylinder seal is commonly provided with a forward sealing face that conforms with the outer-cylindrical contour. High pressure tends to force the floating seal into sealing engagement with the cylinder during spraying, preventing leakage.

To prevent leakage during start up conditions, an initial compressive loading is typically applied to the seal. For example, in the U.S. Pat. No. 4,715,537 to Calder (1987), the floating seal is biased by a spring to provide initial sealing pressure during start up. The floating seal is sealed against leakage from its rearward face by an annular (O-ring) seal.

Existing seals exhibit, in varying degrees, a tendency to cause a "spit" or drip from the spray nozzle, particularly when pressure is suddenly removed. Moreover, these seals in many cases are difficult to assemble in proper alignment, as is necessary for an effective seal. Some existing tips have a further problem: when the rotatable metal cylinder is partially rotated out of alignment with the fluid supply port, seal leakage can occur due to the paint "bridging" the seal between the port and an outside surface. This troublesome "bridging" situation is illustrated by FIG. 1. This figure shows the position of the nozzle carrier 1 when it has been turned partially so that the nozzle axis 2 does not align with the longitudinal axis 3 of the fluid passage 4. If the dimension $w_o$, is not sufficiently narrow to be fully covered by the concave face 5 of the piston seal 6 while in this intermediate position, the seal formed by the contact between the concave face 5 and the nozzle carrier 1 is bridged, and fluid (symbolized by flow line 7) is allowed to escape by flowing around the concave seal face 5. Therefore, to prevent bridging the seal, the arc defined by the opening of the rear nozzle carrier orifice 8 must be smaller than the arc defined by the concave seal face 5. This limitation is defined by a complex relationship, but for small concave faces (as used for practical sealing faces) and assuming that the fluid passage 4 is centered in the piston seal 6, it is sufficient to prevent bridging if the width $w_o$ is less than $(d_{ps}-w)/2$, where w is the width of the fluid passage 4, $d_{ps}$ is the outside diameter of the piston seal 6, and $w_o$, is the width of the rear orifice in the spray nozzle carrier 1.

Prior reversible spray tips have had problems related to the manner of retaining a spray nozzle 9 in the rotatable cylindrical spray nozzle carrier 1. Typically, a small tungsten carbide spray nozzle is installed in a transverse bore of the nozzle carrier 1, so that the axis of the nozzle is perpendicular to the axis of the nozzle carrier 1. The transverse bore of the carrier 1 has a small step or bevel 10 which limits movement of the spray nozzle in the forward direction. A retainer 11 is installed behind the nozzle to secure its position in the bore. The nozzle must be mechanically retained in the carrier 1 such that fluid will not leak past the nozzle in either the forward or reverse flow direction. Furthermore, the nozzle must be mechanically retained in the carrier securely, to prevent it from being dislodged or ejected under very high fluid pressure (as high as 25,000 P.S.I in either the forward or reverse direction). It is also desirable that, in the reverse flow direction, some device is provided to diffuse the fluid stream to reduce the potential of injury from fluid injection while cleaning the spray tip by reverse flow. A transverse pin is often positioned across the fluid flow port for this purpose.

Previous reversible spray tips have generally retained the spray nozzles in the cylindrical carriers by either (a) threading the retainer into the carrier behind the nozzle, or (b) press fitting the retainer into the carrier behind the nozzle. The threaded retainer has high reverse load capacity but is costly and difficult to assemble. The difficulty arises because the spray pattern is not circularly symmetrical. The asymmetrical spray pattern must be oriented to the axis of the carrier (and therefore also to the spray tip assembly) to orient the maximum pattern width in the direction of spray gun movement. Since the threaded spray nozzle is rotating as it is screwed into the retainer, it is difficult to effect and maintain precise alignment of the nozzle in its seated position.

With a press fitted nozzle retainer, on the other hand, rotational alignment is not as great a problem. However, press fitting requires very tight tolerances and precise pressing technique to insure retention. In addition, the wall thickness of the retainer must be heavy enough to provide high compression pressure at the press fit interface. The wall thickness required causes the press fit hole to be 'so large that it will sometimes bridge the fluid seal in some positions and allow troublesome fluid leakage.

Some prior reversible spray tips have an additional problem related to the seal between the rearward end of the floating piston seal and the forward end of the spray gun. For example, Eull in his U.S. Pat. No. 4,165,836 discloses the use of a resilient sealing member interposed between the forward face of the spray gun and the rearward face of the piston seal, the sealing member having a forward end bevel which is received by a conical seat in the piston seal. This arrangement is disadvantageous in that the inside diameter of the sealing member is exposed to the fluid to be sprayed. The resilient sealing member is typically made from an organic elastomer, which can undergo chemical reactions with the fluid being sprayed, causing the elastomer to swell. The swelling of the elastomer then tends to constrict or choke off the flow of fluid through the tip, rendering the spray tip inoperable. In addition, the resilient sealing member contributes to "spitting" through the spray nozzle by reducing the rate at which fluid pressure rises and falls in response to the gun being triggered on and off.

Another problem with existing reversible tips is that they are not easily identified by the user by quick visual inspection. Although the handles of the interchangeable spray tip assemblies are frequently marked, for example with embossed part numbers, in a painting environment such markings are eventually obscured by buildup of paint or other contaminants. The paint buildup is not easily wiped from the handle, especially if it is partially dried, as is common after a long spraying session. This problem somewhat depreciates the value of the interchangeability feature of the spray tips. One cannot take full advantage of interchangeable tips if they cannot be conveniently distinguished in a workplace environment.

SUMMARY OF THE INVENTION

The invention is an improved reversible airless spray tip with several features which cooperate to inhibit dripping, spitting, and undesirable paint accumulation on the spray guard, while improving safety and convenience for the user.

An improved, aerodynamic spray guard having airfoil-like crossbars protects the user from accidental injection injury. The airfoil design of the crossbars inhibits turbulence and prevents paint accumulation on the spray guard, which would otherwise tempt the user to recklessly remove the spray guard.

A positioning detent on the spray tip carrier handle snaps positively into place when the tip carrier nozzle carrier is rotated into spray position, providing tactile feedback indicating to the user that the reversible tip is properly positioned for spraying. The positioning detent also resists accidental rotation of the nozzle carrier, which would otherwise cause accidents.

The invention also includes an improved floating seal with a slot-like fluid passage, which is preferably substantially rectangular in cross-section, with the longer dimension substantially perpendicular to the direction of rotation of the tip carrier. The fluid flow rate is improved by the increased cross-section presented by the rectangular fluid passage, as compared to conventional fluid passages with round cross-sections. This advantage is attained without concurrently increasing the likelihood of paint bridging the seal when the nozzle carrier is partially rotated (which would allow pressurized paint to escape). The rectangular cross section of the fluid passage also provides an asymmetry for a tool to engage for rotating the seal into the proper orientation, thereby facilitating proper installation and a proper initial seal.

A rearward end of the floating piston seal is sealed by a resilient, annular ring, preferably oval in cross-section. The ring is confined and compressed by a face of the spray gun on its rearward side, a housing on its outer circumference, and the floating seal on its inside circumference and its forward side. This configuration shortens the length of the floating seal as compared to existing spray tips, and enables placement of a spray gun needle valve closer to the spray tip's outlet nozzle, thereby reducing spitting and dripping problems. An additional benefit is that this configuration prevents the resilient seal from interfering with fluid flow by preventing inward expansion or distortion.

A nozzle assembly is retained in the rotatable nozzle carrier by a nozzle retainer inserted behind the nozzle. The nozzle retainer has a lip which is insertable into the transverse bore of the nozzle carrier, but which is expanded during assembly by applying pressure with a swage tool, which causes the lip to engage a corresponding groove in the nozzle carrier. The swaging process also creates and expansion chamber in the retainer, which acts to diffuse liquid flowing in a reverse direction through the nozzle assemble (as for cleaning).

DETAILED DESCRIPTION OF THE INVENTION

Figure 2:
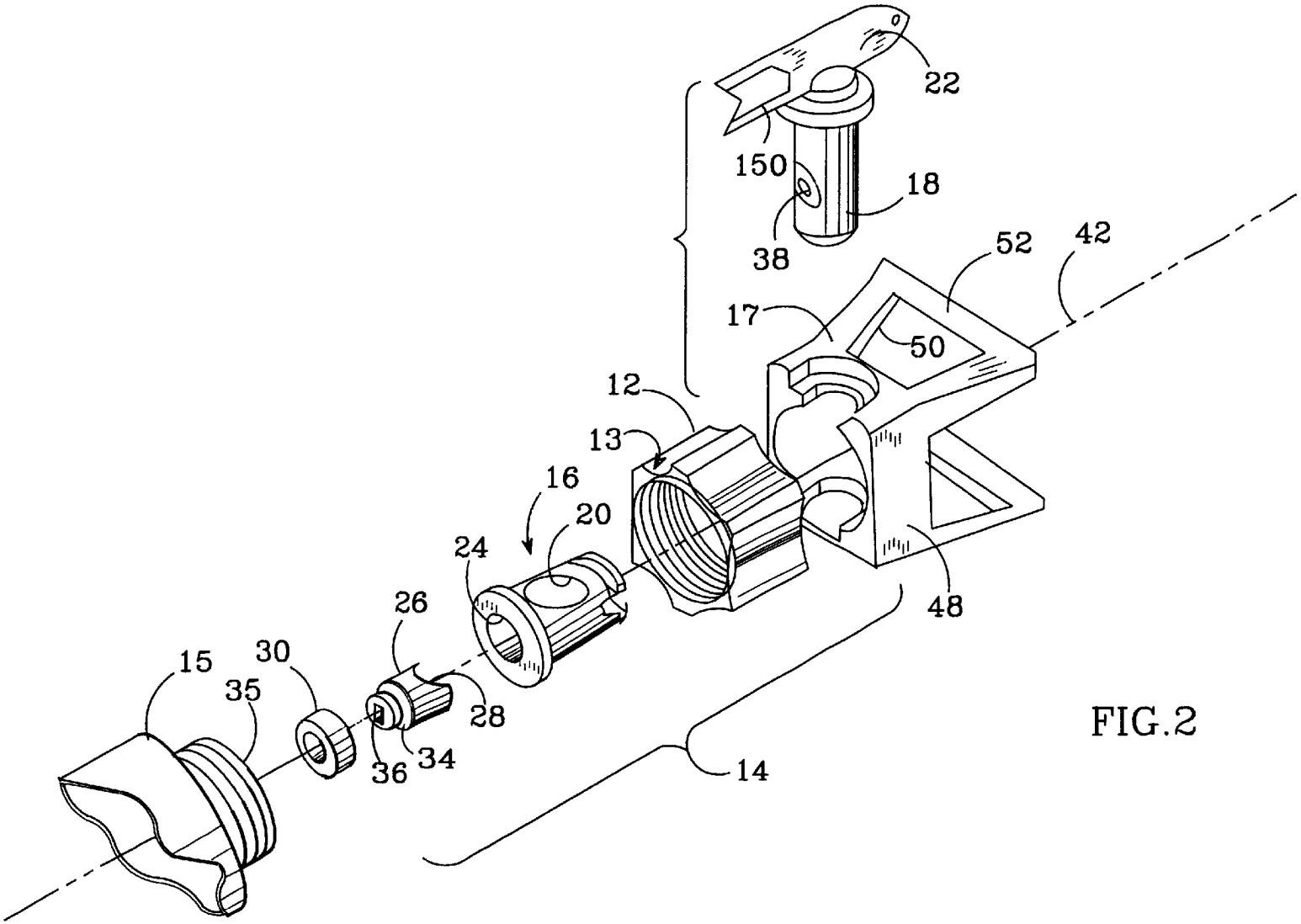
FIG. 2 is an exploded perspective view of one embodiment of the invention.

In the exploded view of FIG. 2, an internally threaded retaining nut 12 with scalloped gripping surfaces 13 allows a user to mount the entire spray tip assembly 14 onto a conventional pressurized spray gun 15 (shown only partially for clarity) having complementary threads. A metal body 16 inserts axially through retaining nut 12 into a spray guard 17. A cylindrical spray nozzle carrier 18, which slidably and rotatably fits into a transverse bore 20 in the body 16, can be rotated into spray position (shown) or a reversed cleaning position (180 degrees rotated from the position shown) by turning an attached handle 22.

The body 16 has a longitudinal bore 24 substantially perpendicular to the transverse bore 20 which it intersects. This longitudinal bore 24 receives a substantially cylindrical piston seal 26 with a concave forward sealing surface 28 which mates with the cylindrical contour of the nozzle carrier 18. An annular seal 30 seals the rearward end of the piston seal 26 as it is compressed between the rearward shoulder 34 of the piston seal 26 and the forward face 35 of the conventional pressurized paint spray gun 15.

A fluid passage 36 with a preferably rectangular cross section extends longitudinally through the piston seal 26. When the nozzle carrier 18 is rotated into spraying position or cleaning position, a nozzle assembly 38, which is mounted diametrically in a bore through nozzle carrier 18, aligns axially with the fluid passage 36. As pressurized fluid is supplied from the attached spray gun (mounted behind annular sealing member 30), the fluid is allowed to flow forward through fluid passage 36, then through nozzle assembly 38, escaping externally in a fan shaped spray pattern along longitudinal axis 42.

Figure 3:
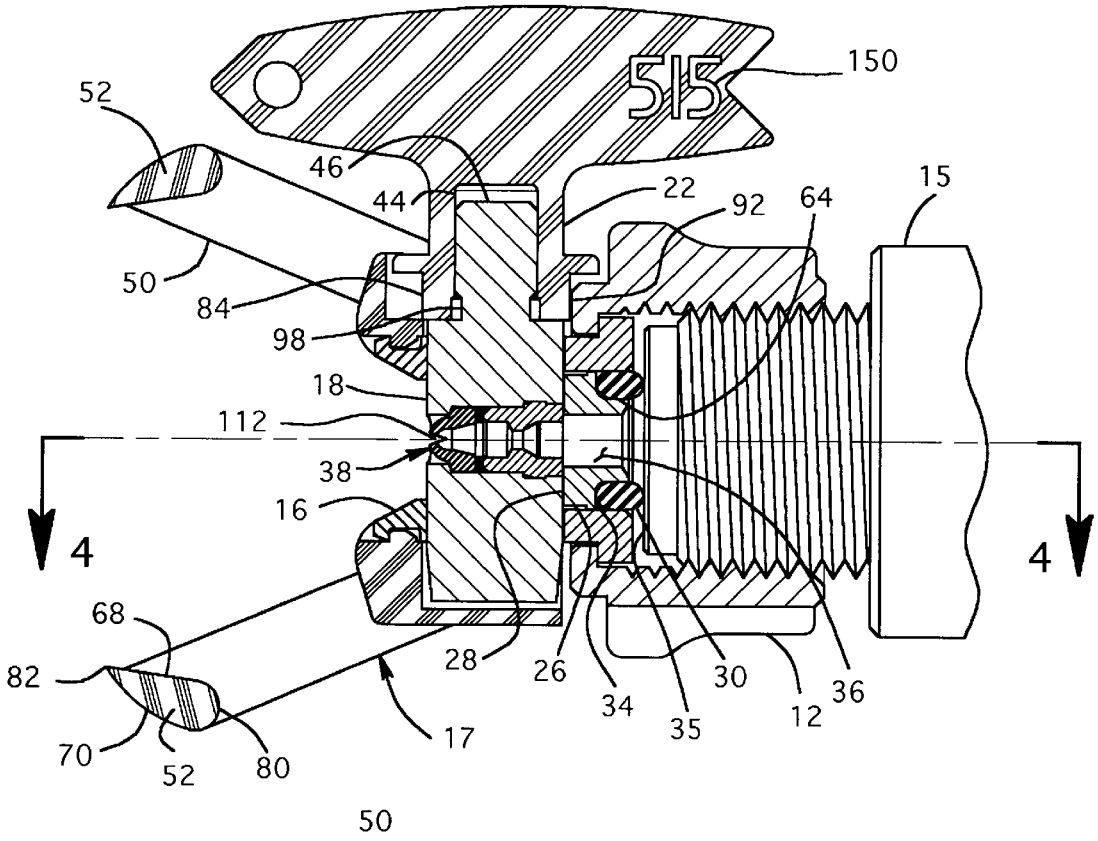
FIG. 3 is a sectional view of the embodiment shown in FIG. 2.

The nozzle carrier 18 slidably passes through an opening in the body portion of spray guard 17 to insert in the transverse bore 20 of the body 16. As in prior reversible spray tip devices, the handle 22 is attached to the nozzle carrier 18, suitably by pressing a splined shaft 44 of nozzle carrier 18 into a compatible bore 46 in handle 22 (as shown in FIG. 3). The nozzle carrier 18 is thus constrained to co-rotate with the handle 22. The handle thus connected enables the user to rotate the nozzle carrier 18 between a spray position and a reversed flow, cleaning position.

The spray guard 17 includes a body section 48, suitably four support arms 50 extending outward and forward, and typically two aerodynamic airfoils 52, each supported by and spanning the forward ends of two support arms 50. This spray guard 17 helps to prevent objects, especially a user's hand from intercepting the high velocity spray jet near the nozzle assembly 38 (where the jet velocity is highest and the stream most narrow). Although fingers can fit into the guard between the "wings", the guard serves as a warning and establishes a safe distance reference boundary.

Figure 4:
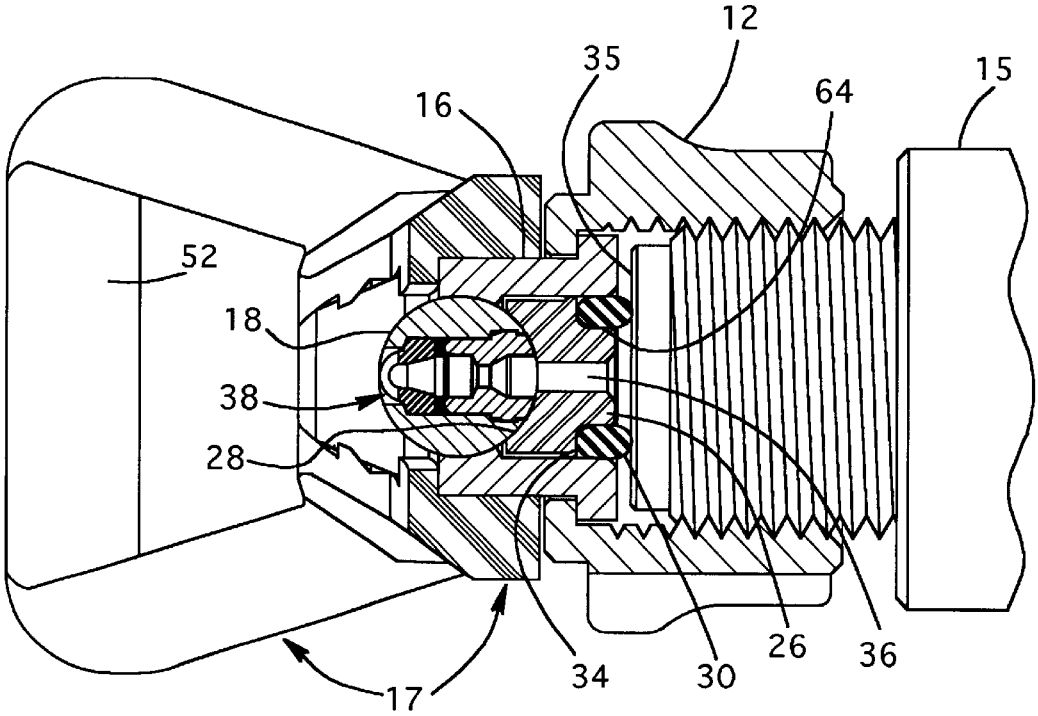
FIG. 4 is a cross-section of the invention taken along section line 4—4 in FIG. 3.

More detailed internal structure can be seen in FIGS. 3 and 4, which show the assembly mounted on a spray gun 15 and aligned with the nozzle carrier 18 in its spray position. Pressurized fluid flows forward through fluid passage 36 in the piston seal 26, then continues forward through nozzle assembly 38 which is mounted in the diametric bore through nozzle carrier 18. When the nozzle carrier 18 is rotated into the spray position as shown, pressurized fluid (typically paint) is forced forward through the nozzle assembly 38 and exits at high velocity along the central longitudinal axis 42. A seal is created by the close contact between the nozzle carrier 18 and the semi-cylindrical face 28 of the piston seal 26. The piston seal 26 is also sealed at its rearward end by the annular seal 30, which is compressed between the spray gun face 35 on its rearward portion and a shoulder 34 of the piston seal 26 on its forward portion, the metal body 16 on its outside periphery and a neck portion 64 of the piston seal 26 on its inside diameter. Fluid pressure acting on annular seal 30 forces the piston seal 26 against the nozzle carrier 18. The effective area of annular seal 30 is greater than that of fluid passage 36 which results in increased sealing force between piston seal 26 and nozzle carrier cylinder 18 in proportion to pressure applied.

It can be seen in FIG. 3 that the spray guard 17 has (preferably two) airfoils 52. Each airfoil 52 has a characteristic aerodynamic design similar to a wing, with a curved outer surface 70 and a relatively flat inner surface 68 (analogous to the top and bottom, respectively, of an airplane wing). The airfoil cross-sections reduce air turbulence and create higher pressures near the inner surfaces 68 of the spray guard 17.

Figure 5:
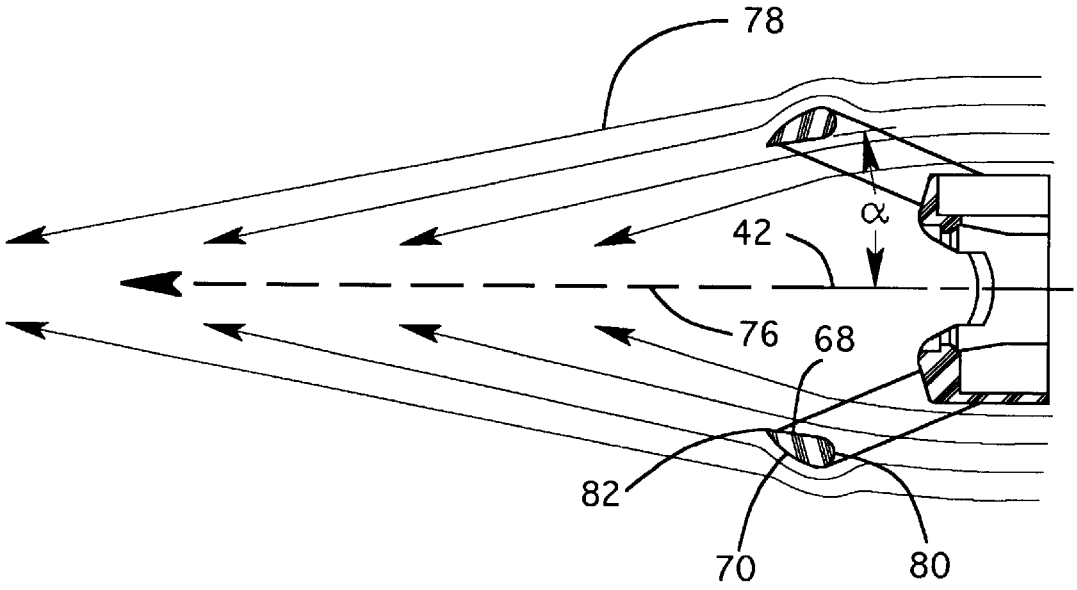
FIG. 5 is a simplified sectional view schematically showing assumed streamlines of air flow around the spray guard of FIG. 2.

FIG. 5 shows by streamlines the pattern of air flow generated in the region near the spray guard 17 when paint is sprayed in a fluid stream 76. As the high velocity fluid stream 76 is sprayed forward, air is necessarily drawn into and along the fluid stream 76, following the streamlines 78. Each airfoil is situated with a rounded leading edge 80 disposed upstream (toward the fluid stream) and a substantially sharper trailing edge 82 disposed downstream. The air near the spray guard flows over the airfoil inner and outer surfaces 68 and 70 and merges easily into the atomized fluid stream, without turbulence.

The air on the outer airfoil surfaces 70 of the guard will have lower pressure, while the air flowing across the inner airfoil surfaces 68 will have increased pressure due to the airfoil effects.

The angle $\alpha$ of the airfoil relative to the axis 42 of the spray jet 76 should preferably be small, in the neighborhood of 5 to 30 degrees. If the angle is too large, a stalling condition may result, causing turbulence and increasing paint accumulation on the spray guard.

Provided that stalling is avoided, the airflow design of the spray guard allows the air to flow easily without turbulence, which reduces the accumulation of paint overspray on the spray guard and the spray gun (as compared with prior spray guard designs). The reduced accumulation of paint enhances both the efficiency and the safety of the paint sprayer: efficiency because it allows the user to continue spraying for longer periods without interruption for wiping; safety because it reduces the motivation for the reckless user to remove the spray guard, which would cause increased risk of injection injury.

Figure 6:
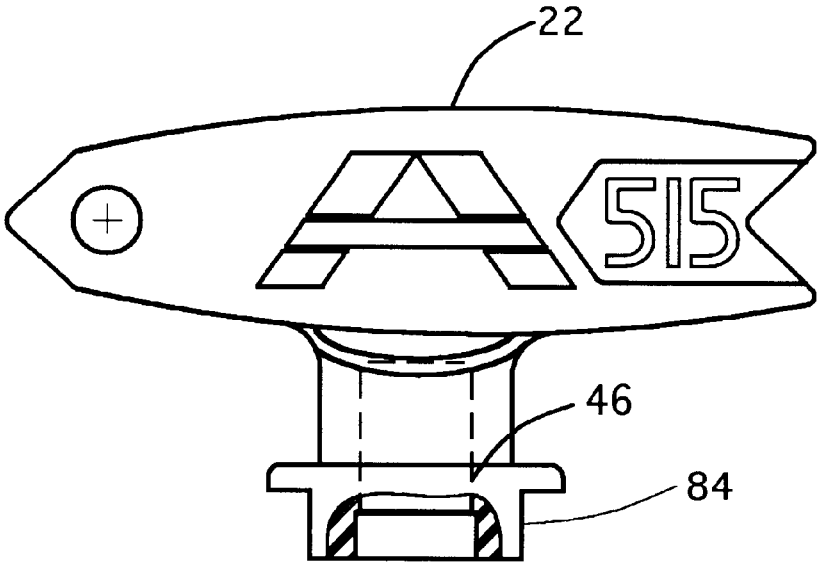
FIG. 6 is an elevation view of a handle used in the embodiment of FIG. 2.
Figure 7:
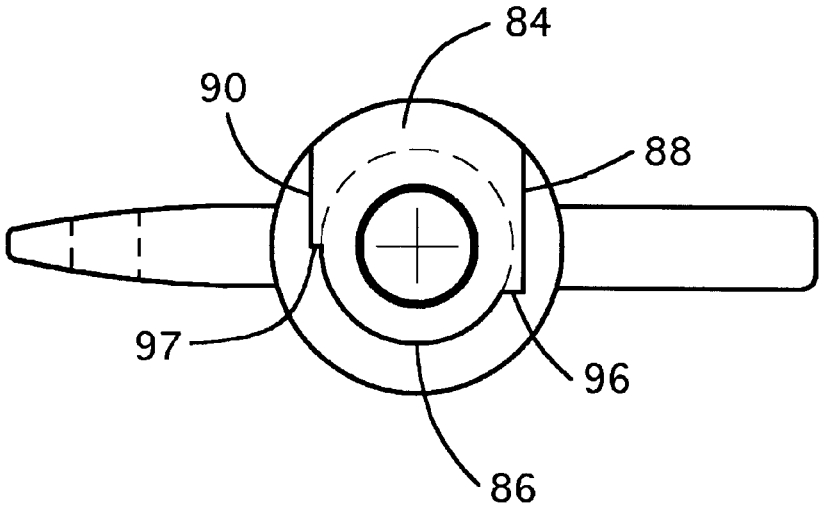
FIG. 7 is a lower plan view of the handle of FIG. 5.

Efficiency and safety are also enhanced in one embodiment of the invention by an improved nozzle carrier handle 22 shown in FIGS. 6 and 7 (detached from the nozzle carrier 18 for clarity). The handle 22 includes a cam 84 which is preferably integral with the handle, and is preferably made from an slightly elastically deformable material such as an organic polymer. The rim of the cam 84 has a substantially rounded portion 86 coaxial with said nozzle carrier 18, and (preferably two) substantially flat rotation stops: a spray position stop 88 and a clean position stop 90. Both stops 88 and 90 are substantially. parallel to the axis of the nozzle carrier 18. The spray position stop 88 and the clean position stop 90 are positioned to limit rotation of the handle 22 by contacting a stationary surface 92 (shown in FIG. 8*a*) of a counterstop (preferably a flange-like forward surface of the retaining nut 12) at the limit of rotation in either direction, giving the handle 22 and the nozzle carrier 18 the freedom to turn through approximately 180 degrees from stop to stop. These rotational limits position the tip in either the clean or spray positions, allowing either forward or backward fluid flow through the nozzle assembly 38.

A position stop 88 is offset by a detent 96 which extends to a greater distance from the nozzle carrier axis than the adjacent surface of the rounded portion 86. The detent 96 contacts the stationary surface 92 before the handle has rotated fully against the spray position stop 88. The interference between the detent 96 and the stationary surface 92 causes elastic deformation of the detent 96 and the cam member 84 as it is forcibly rotated by a user into the spray position. As shown in FIG. 3, a portion 98 of the shaft 80 has a reduced diameter, thereby providing a slight space between the shaft portion 98 and the nozzle carrier 18. This space permits the elastic deformation required for the cam member to rotate past the detent 96 and into the spray position. The same result could be reached by providing an enlarged portion of the bore 82, which would also provide the necessary clearance.

Figures 8A, 8B, 8C, 8D:
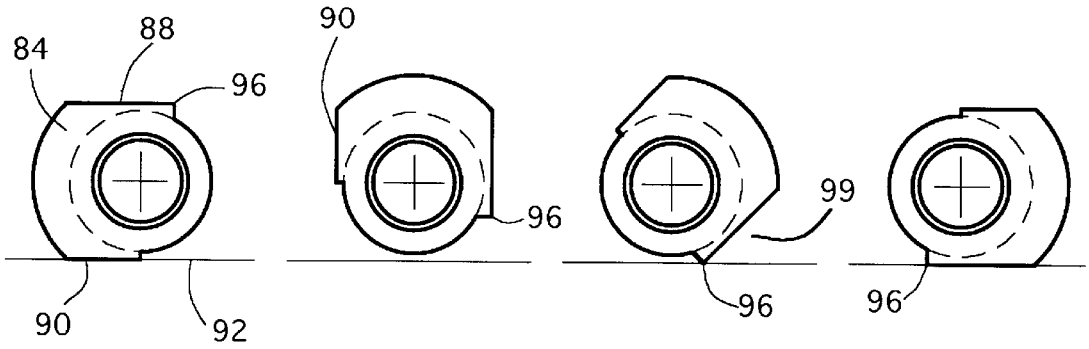
FIGS. 8*a*, 8*b*, 8*c* and 8*d* are a series of sectional views of the handle's cam portion, illustrating how it can be rotated through successive positions relative to a stationary surface.

FIGS. 8*a* through 8*d* illustrate a sequence of rotating the stop from the clean position of FIG. 8*a* into the spray position of FIG. 8*d*. In FIG. 8*a* the handle is in the clean position, with clean position stop 90 engaged against the stationary surface 92. In FIG. 8*b* the handle has been rotated so that the cam surface 86 is not in contact with the stationary surface 92, allowing free rotation of the handle and attached nozzle carrier 18. In FIG. 8*c* the handle has been rotated further so that the detent 96 contacts the stationary surface 92. At this rotational position the interference between the detent 96 and the stationary surface 92 produces a torsional resistance to rotation which can be felt by the user, providing tactile feedback as to the position of the spray tip. The phantom outline 99 shows the position which the cam 84 would have taken but for the deformation caused by the pressure from the stationary surface 92. Once the detent 96 is rotated beyond the center plane of the handle 22, the elastic return of the deformed cam urges the detent against the stationary surface 92, tending to aid rotation until the spray position stop 88 is in full contact with the stationary surface 92 as shown in FIG. 8*d*. In passing from FIG. 8*c* to FIG. 8*d* the handle can be felt to snap into position. This indicates positively to the user that the spray tip is in spray position and ready to spray.

Because of the interference between the detent 96 and the stationary surface 92, to rotate the handle 22 out of position a much higher force is required than that needed to overcome only the friction of the nozzle carrier 18 against the body 16 and the fluid seal 26. This requirement of higher turning force (torque) serves to better hold the tip in alignment until the user rotates it deliberately. The result is improved safety and productivity.

Figure 9:
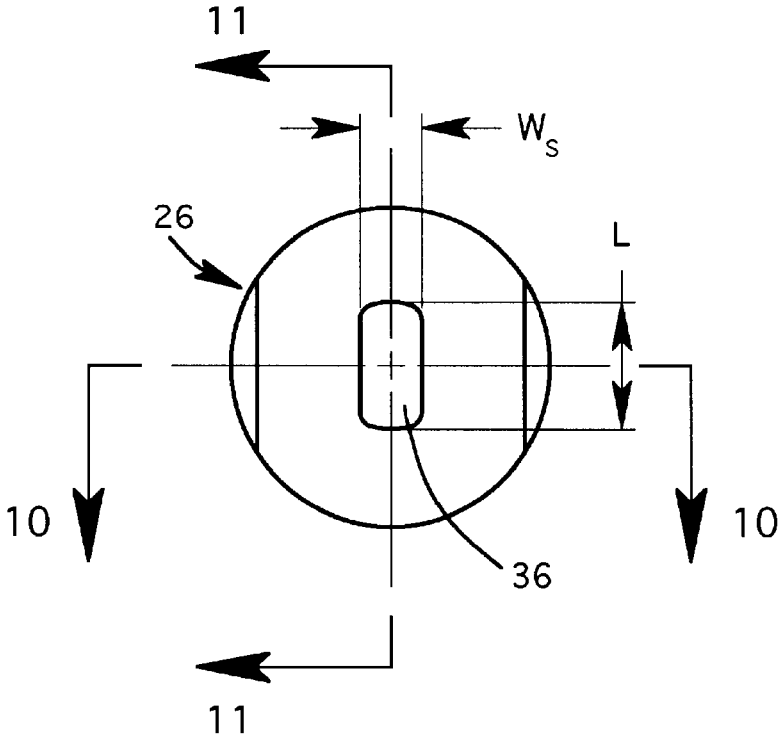
FIG. 9 is a frontal view of a piston seal used in the embodiment of FIG. 2.
Figure 10:
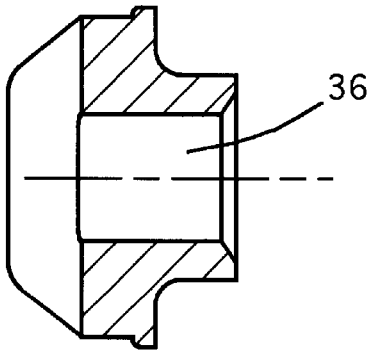
FIGS. 10 and 11 are sectional views of the piston seal, taken along section lines 10—10 and 11–11, respectively, in FIG. 9.
Figure 11:
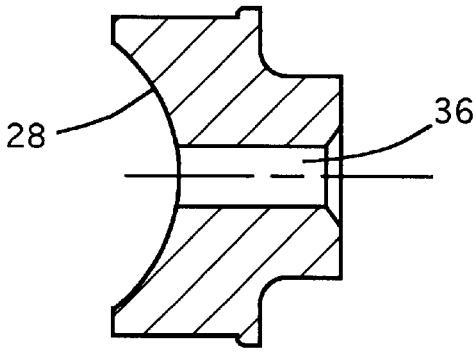

Safety, cleanliness, efficiency, and versatility of the spray tip are all enhanced by an improved piston seal 26 with a non-cylindrical fluid passage 36 which is preferably rectangular in cross section. Unlike the piston seals of prior spray tips, which have fluid passages generally round in cross-section, the piston seal 26 of the invention features a fluid passage 36 with a slot-like, rectangular cross-section of length L and width $w_s$, as shown in FIGS. 9 10 and 11. The longer dimension L of the fluid passage should be oriented substantially parallel to the axis of the nozzle carrier 18 and the (coaxial) transverse bore 20 in body 16. The width $w_s$, of the fluid passage 36 should be sufficiently narrow to prevent bridging when the tip is reversed by rotating the cylindrical tip carrier 18.

Figure 1:
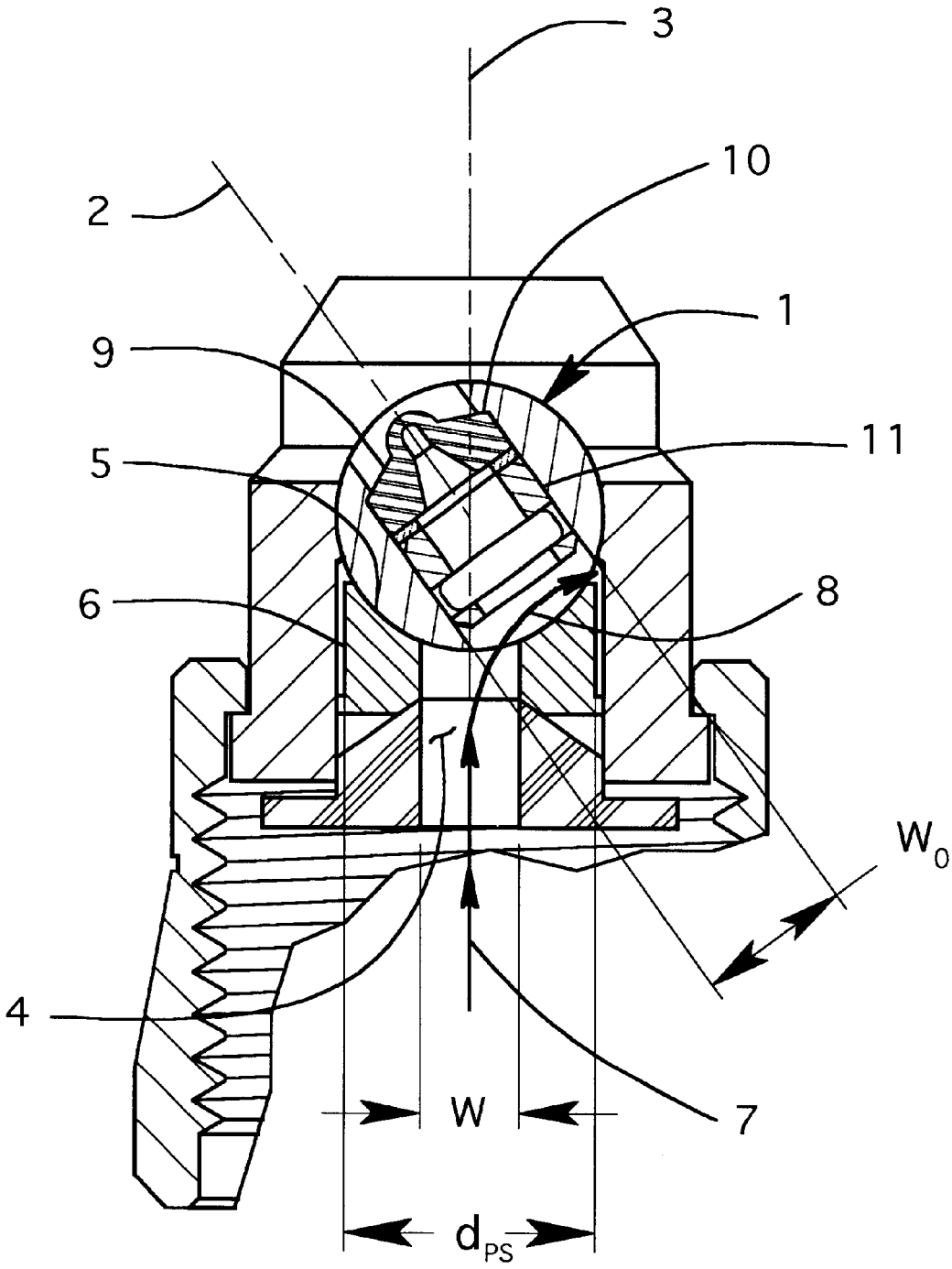
FIG. 1 is a sectional view of a prior art reversible spray tip assembly.

As in the prior art, the critical maximum width of $w_s$ to prevent bridging depends on several factors, as illustrated in FIG. 1 and discussed in connection with the prior art. The maximum width permitted thus depends upon several dimensions, but there are practical constraints on each dimension. First, the diameter of the spray nozzle orifice depends upon the material to be sprayed and the flow rates desired. For high density materials such as roof coating, and high flow rates, an orifice in the range of 0.070 inches or larger is desirable. The contact width of the piston seal with the nozzle carrier cannot exceed the width of the spray nozzle carrier. The spray nozzle carrier size is in turn constrained because very large diameters become difficult for a user to turn due to friction caused by dried paint and/or seal pressure being increased and imposed on a greater radius. Nozzle carriers with cylinder diameters in the range of ¼ to ½ inch are desirable, and a diameter of approximately 7/16 inch is common. In a typical embodiment, a fluid passage 36 with $w_s$ of 0.080 inches and an L of approximately twice $w_s$ are suitably used with a nozzle carrier 18 of approximately 7/16 inch diameter and a piston seal with an outer diameter of 7/16 inches.

The non-cylindrical fluid passage 36 of the invention is advantageous because it allows the cross-sectional area of the fluid passage 36 (cross-section taken normal to direction of fluid flow) to be made larger (for a given size piston seal)

while having a desirably wide sealing land in the plane of tip rotation as compared to a conventional round fluid port with diameter w. To prevent bridging when the nozzle carrier 18 is being rotated, the useable maximum diameter of any round fluid port is limited (as discussed above). The maximum cross sectional area of a conventional round fluid port is thus limited to $\pi W_s^2/4$ (because $r=w_s/2$ and area$=\pi r^2$). A rectangular port, in contrast, with dimension L greater than or equal to $w_s$ can achieve a significantly greater cross-sectional area (equal to $l \times w_s$).

The increased available cross-sectional area of the fluid passage presents less restriction of the fluid flow and permits the use of larger spray tip orifices. Alternatively, if the design goal is primarily to reduce leakage or reduce size, the rectangular passage is advantageous in allowing a reduced size for the concave face 28, the nozzle carrier 18, and the piston seal 26 for a given fluid passage cross-section and flow rate requirement.

Many shapes other than a rectangular cross section could be used for the fluid passage in the invention, provided that the chosen shape has a longer dimension in a direction substantially parallel to the axis of rotation of the nozzle carrier 18. For example, oval or elliptical orifices could be used. Such variations are within the intended scope of the invention.

The rectangular fluid passage (or one of the aforementioned variations) is also useful in manipulating the piston seal 26 during installation into the body 16. For example, a slotted port can accept a correspondingly shaped tool (in the manner of a mortise and tenon) for rotating the piston seal 26 during installation into the body 16; a round port cannot engage such a tool.

The method employed by the invention to seal the rear portion of the piston seal 26 shortens its length as compared to prior spray tips, and enables placement of a spray gun needle valve closer to the spray tip's outlet orifice 112. To reduce spitting, it is highly desirable that the fluid passage 36 through the piston seal 26 be as short as possible. Commercial paint mixes commonly include entrapped air or other compressible components, making the liquid somewhat compressible. When pressure is suddenly removed, for example by closing a needle valve on the spray gun, a small volume of paint trapped in the fluid passage 36 does not cleanly stop flowing, but rather expands as the pressure drops, resulting in spitting of paint. This troublesome effect is mitigated by reducing the volume of the fluid passage 36, thereby reducing the volume of pressurized paint trapped between the spray gun's needle valve and the outlet orifice 112. This volume is best reduced by shortening the length of the channel rather than its cross-section, as a small cross-section tends to inhibit paint flow. Therefore, the reduced length of the fluid passage 36 within the piston seal 26 offered by the invention is very important in reducing spitting.

The rearward sealing arrangement of the invention reduces the length of the fluid passage 36 as compared to prior spray tips. The fluid seal of the present invention shown in FIG. 2 requires only one resilient annular seal 30. The annular seal 30 encircles a neck portion 64 of the piston seal 26 and is surrounded on its outside perimeter by the longitudinal bore 24 in the body 16. The seal 30 is compressed by the shoulder 34 of the piston seal 26 as it is forced toward the forward face of the spray gun 60, when the entire tip assembly is mounted by screwing the mounting nut 10 onto the spray gun 60.

The resilient annular sealing member 30 itself provides a bias for the floating piston seal 26, eliminating the need for a spring and the additional length previously required to accommodate the spring. The present seal thus shortens the fluid channel 36 and thus the volume available to pressurized fluid downstream from the spray gun valve. This reduces the volume of entrapped pressurized paint, and thereby reduces the tendency of the spray tip to spit when the pressure is released.

The approach taken by the invention is also an improvement over the design disclosed by Eull in his U.S. Pat. No. 4,165,836 (discussed above). Significantly, in contrast with the sealing member used by Eull, in the present invention the inside diameter of the resilient annular sealing member 30 is not free to contract inward, constricting paint flow. The outer surface of the piston seal's neck 64 contacts the inside diameter of the resilient annular sealing ring 30 and prevents it from contracting under any conditions, so that paint flow cannot be restricted by sealing ring swelling.

The resilient sealing ring 30 should preferably be made of a somewhat resilient elastomeric, solvent resistant material such as a saturated ethylene-octene copolymer. The resilience of the material will provide pressure on the piston seal 26 so that the seal will not leak upon initial start up (application of paint pressure). The seal is preferably not round in cross-section, but rather elongated in one direction (for example, oval). This shape accommodates greater range of compression in the direction of elongation, and produces greater compressive force to properly bias the floating piston seal 26 while sealing between the floating piston seal and the forward face 35 of the pressurized spray gun 15.

Figure 12A:
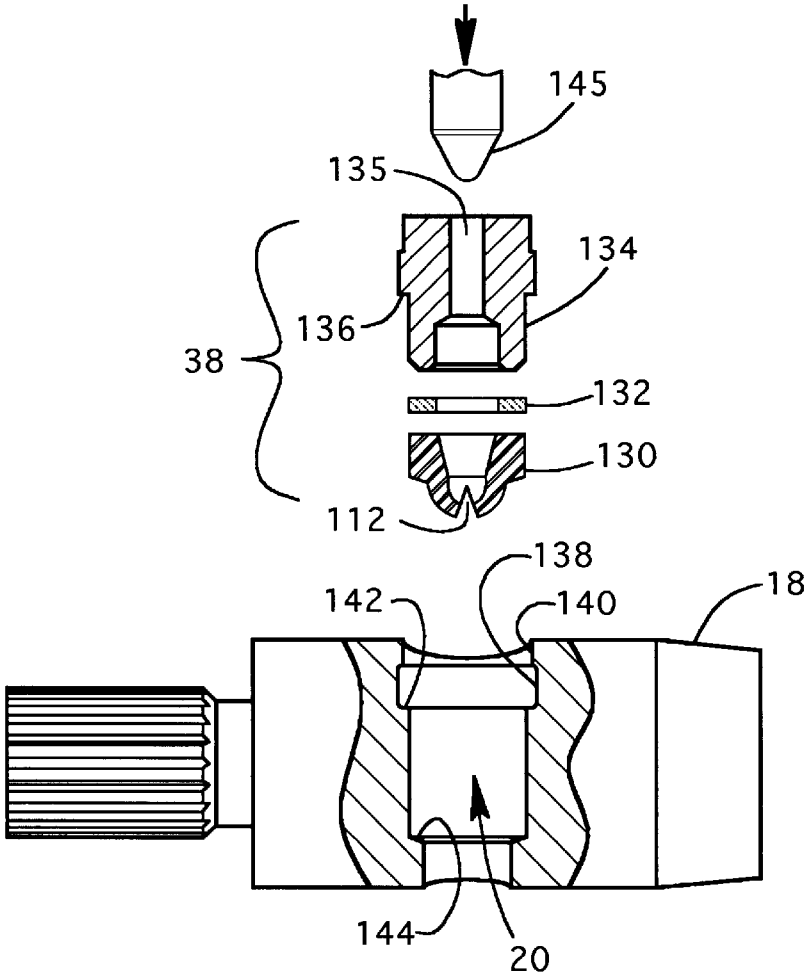
FIG. 12*a* is an exploded sectional view of the nozzle assembly and the spray nozzle carrier of the invention, in their pre-assembly form, together with a swaging tool applied during assembly.
Figure 12B:
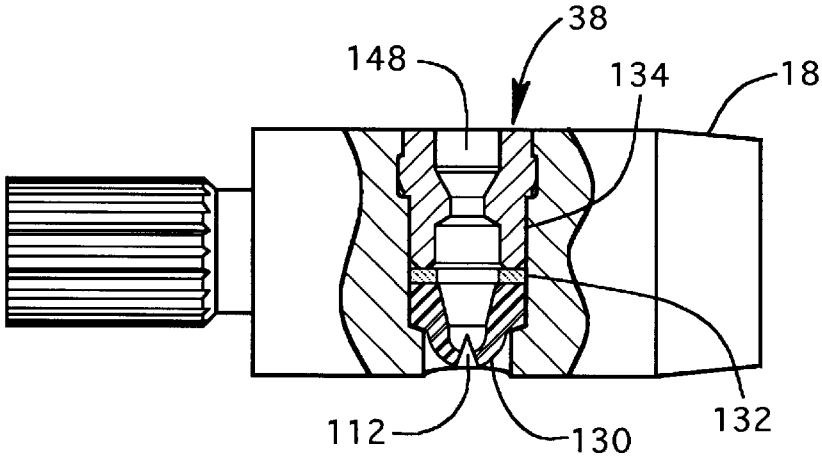
FIG. 12*b* is a sectional view of the nozzle assembly as it appears after it has been inserted into the nozzle carrier and swaged.

Details of a nozzle assembly 38 of the invention are shown in FIGS. 12*a* and 12*b*. The assembly includes a spray nozzle 130 (with spray orifice 112), a compressible nozzle gasket 132 which is inserted behind spray nozzle 130 into the transverse bore 20 in the spray tip carrier 18, and a spray tip retainer 134, which is inserted into the transverse bore 20 behind the gasket 132 and retains the assembly in the bore 20.

The retainer 134 is preferably a substantially cylindrical turned part with a small longitudinal inner fluid channel 135 and a radial lip 136 on the outside diameter. The cylindrical spray tip carrier 18 has a radial groove 138 in the transverse bore which is disposed to correspond with the radial lip 136 after assembly. Before assembly, the entrance 140 to the transverse bore 20 has a diameter which is larger than the radial lip 136 and smaller than the diameter of the groove 138. On the forward side of the groove 138, the diameter of the transverse bore closes to a diameter smaller than the radial lip 136, providing a land 142 for the radial lip 136 to bear against for positioning during a swaging process.

To assemble the spray tip assembly 38, the spray nozzle is first inserted into the transverse bore 20 in spray tip carrier 18 and positioned at the forward end of the bore 20, where it is stopped by the forward shoulder 144 of the bore 20. The orifice 112, which is typically non-symmetrical, is manually aligned in relation to the axis of the spray tip carrier (by rotating it about the longitudinal axis of the bore 20, thereby aligning the resulting paint spray pattern). The fluid sealing gasket 132 is then installed in the bore behind the spray nozzle 130. The tip retainer 134 is inserted behind the gasket 132, with the retainer's smaller-diameter end facing outward (rearward). A tapered swaging tool 145 is then pressed into the entry hole 135 of the retainer 134, preferably to a predetermined depth. This pressing forces the retainer 134 into the land 142 which compresses the gasket 132 to a pre-determined thickness. Because of the pressure exerted by the swaging tool 145, the outside features of the retainer 134 expand causing the radial lip 136 to expand into the groove 138. The engagement of the retainer radial lip 136 with the groove 138 secures the retainer, and hence the spray tip assembly 38, within the carrier 18. The outer diameter of the retainer 134 expanded, by the same swaging action, into tight contact with the transverse bore, creating an almost seamless joint. The outside diameter of the tip carrier 18, with the spray tip assembly 38 installed, is then preferably ground (by centerless grinding) to remove any portion of the retainer 134 which projects above the cylindrical surface of the carrier 18, resulting in a smooth, cylindrical surface (which mates closely with the piston seal 26, as previously described).

FIG. 12*b* shows the assembly seated in the carrier after swaging. A flared expansion chamber 148 is visible near the rear of the retainer 134. This chamber 148, which is formed by inserting the tapered swaging tool 145 under pressure, expanding the small inside bore, creates a venturi effect in the bore of retainer 134. As a result of the expansion chamber 148, fluid flowing in the reverse flow direction, as when the carrier is reversed for spray tip cleaning, becomes diffused as it exits the spray nozzle assembly 38, rather than exiting in a narrow jet. This enhances safety of the device without distorting the spray pattern (as do some pin-type diffusers).

A final feature of the invention is an improved identifying mark or feature which allows a user to identify the size or type of a spray nozzle quickly and with certainty even in an environment which includes excess paint, as from overspray, mis-sprays, spills, or other problems which vex a painter. As in prior spray tips, various nozzle assemblies are available, and are easily interchanged by sliding out and replacing the entire nozzle carrier 18 with attached handle 22. In a preferred embodiment of the invention, the handle 22 is perforated with an identifying perforation 150 (visible in FIGS. 1 and 2), which is a mark or symbol identifying the size and type of nozzle assembly 38 in the attached nozzle carrier 18. For example, as illustrated by FIGS. 1 and 2 the alphanumeric identifier "515" is perforated through the handle to identify one particular spray nozzle. The user can easily inspect the perforation while the nozzle carrier 18 is fitted into or removed from the bore 20, making spray nozzle identification quick and convenient. Paint does not tend to accumulate inside a perforation as readily as it does on, for example, embossed lettering; any paint which does accumulate is more easily cleaned from a perforation than from embossed lettering, for instance by passing a cleaning implement completely through the perforation. Thus the identifying perforations do not easily become unrecognizable due to paint accumulation, as do prior spray tip markings.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An improved spray tip guard for use with and adapted for mounting on an airless sprayer which expresses a high velocity fluid jet in a forward direction from a spray nozzle, generally defining a jet axis, comprising:

a first airfoil disposed near the fluid jet to prevent objects from intercepting the fluid jet and to reduce air turbulence in the vicinity of the spray nozzle; and at least one support member supporting said airfoil in spaced relation to said spray nozzle;

wherein the airfoil comprises:

an interior surface disposed toward the fluid jet and an exterior surface disposed away from the fluid jet, a rounded leading edge disposed proximally toward the spray nozzle, and a sharp trailing edge disposed away from the spray nozzle.

2. The spray tip guard of claim 1, wherein said airfoil generally describes a plane angled inward toward the fluid jet axis and converging in the forward direction of fluid expression.

3. The spray tip guard of claim 2, wherein said airfoil is arranged generally at an angle in the range of 10–30 degrees, inclusive, with respect to streamlines of airflow near said fluid jet axis.

4. The spray tip guard of claim 2, wherein said jet axis intersects said plane of said airfoil at an angle in the range of 10 to 30 degrees, inclusive, said angle measured in a plane of projection which is normal to the plane of said airfoil.

5. The spray tip guard of claim 4, wherein said exterior surface of said airfoil has more curvature than said interior surface.

6. The spray tip guard of claim 2, further comprising at least one additional airfoil similar to said first airfoil and supported in spaced relation to said spray nozzle and first airfoil and at an angle to said first airfoil.

7. An improved spray tip guard for use with and adapted for mounting on an airless sprayer which expresses a high velocity fluid jet in a forward direction from a spray nozzle, generally defining a jet axis, comprising:

At least one support member which extends forwardly from the spray nozzle;

at least two crossbars, supported at a forward end of said at least one support member, each said crossbar having an airfoil-shaped cross section with a rounded leading edge and a sharp trailing edge;

said crossbars arranged with said rounded leading edge disposed toward the spray nozzle and said sharp trailing edge disposed away from said spray nozzle.

8. The spray tip guard of claim 7, wherein said crossbars have a substantially flatter inside surface, disposed near an axis of said fluid jet, and a more rounded outer surface disposed away from said axis of said fluid jet.

9. The spray tip guard of claim 8, wherein said crossbars are arranged at an angle to an axis of said fluid jet with their inside surfaces converging in the direction of fluid expression along said fluid jet.

10. The spray tip guard of claim 9, wherein said inside surfaces converge at an angle in the range of 10–30 degrees, inclusive, with respect to said axis of said fluid jet.

* * * * *